US009114916B2

(12) United States Patent
Knipe

(10) Patent No.: US 9,114,916 B2
(45) Date of Patent: Aug. 25, 2015

(54) COVER WITH DEPRESSIONS FOR CLOSING A CONTAINER

(75) Inventor: Stephen Knipe, Portsmouth (GB)

(73) Assignee: HUHTAMAKI OYJ, Espoo (FI)

( * ) Notice: Subject to any disclaimer, the term of this patent is extended or adjusted under 35 U.S.C. 154(b) by 390 days.

(21) Appl. No.: 12/812,988

(22) PCT Filed: Jul. 16, 2008

(86) PCT No.: PCT/EP2008/059339

§ 371 (c)(1),
(2), (4) Date: Jan. 6, 2011

(87) PCT Pub. No.: WO2009/089927

PCT Pub. Date: Jul. 23, 2009

(65) Prior Publication Data

US 2011/0089066 A1 Apr. 21, 2011

(30) Foreign Application Priority Data

Jan. 17, 2008 (ES) ..... 0859657
Apr. 30, 2008 (DE) ..... 20 2008 006 002 U

(51) Int. Cl.
*B65D 43/03* (2006.01)
*B65D 43/04* (2006.01)
(Continued)

(52) U.S. Cl.
CPC ..... *B65D 43/0212* (2013.01); *B65D 2231/022* (2013.01); *B65D 2543/00092* (2013.01); *B65D 2543/00296* (2013.01); *B65D 2543/00388* (2013.01); *B65D 2543/00509* (2013.01); *B65D 2543/00537* (2013.01); *B65D 2543/00555* (2013.01); *B65D 2543/00638* (2013.01);
(Continued)

(58) Field of Classification Search
CPC ..... B65D 2543/46; B65D 2543/92; B65D 2543/296; B65D 2543/509; B65D 2543/537; B65D 2543/555; B65D 2543/694; B65D 2543/796; B65D 2543/805; B65D 2543/814; B65D 51/245; B65D 2203/00; B65D 1/265
USPC ..... 220/709, 780, 781, 784, 787, 789, 790, 220/380, 792, 703–705, 711–716; 229/103.1, 906.1; D9/438, 447, 452, D9/454
See application file for complete search history.

(56) References Cited

U.S. PATENT DOCUMENTS 2,024,495 A * 12/1935 Wolfe ..... 220/233
2,153,041 A * 4/1939 Gold ..... 215/363
(Continued)

FOREIGN PATENT DOCUMENTS

EP 1787916 A1 5/2007
GB 1471757 A 4/1977

*Primary Examiner* — Anthony Stashick
*Assistant Examiner* — Ned A Walker
(74) *Attorney, Agent, or Firm* — Husch Blackwell LLP

(57) ABSTRACT

A lid for closing a container is provided. The lid may be deep-drawn from a plastics material film or produced in an injection-molding method. The lid includes a substantially downwardly directed edge flange for engaging over a thickening that encircles the container's upper edge. The edge flange can be formed to be inclined outwardly at least slightly and is provided with a plurality of inwardly directed projections capable of engaging under the thickening of the container. The lid also comprises a plurality of depressions. The depressions have a depth that is greater towards an interior lid area than towards the edge flange. The depressions have width that is greater towards the interior lid area than towards the edge flange.

20 Claims, 5 Drawing Sheets

(51) Int. Cl.

| | |
|---|---|
| ***B65D 43/08*** | (2006.01) |
| ***B65D 43/02*** | (2006.01) |
| *A47G 19/22* | (2006.01) |

(52) U.S. Cl.

CPC ..... *B65D2543/00685* (2013.01); *B65D 2543/00731* (2013.01); *B65D 2543/00796* (2013.01); *B65D 2543/00805* (2013.01); *B65D 2585/6875* (2013.01)

(56) References Cited

U.S. PATENT DOCUMENTS

| | | | | | |
|---|---|---|---|---|---|
| 2,671,574 | A | * | 3/1954 | Wolfe | 220/234 |
| 3,048,317 | A | * | 8/1962 | Cochrane et al. | 229/103.1 |
| 3,065,875 | A | * | 11/1962 | Negoro | 220/784 |
| 3,070,257 | A | * | 12/1962 | Bojanowski | 206/508 |
| 3,142,409 | A | * | 7/1964 | Ross | 220/281 |
| 3,156,372 | A | * | 11/1964 | Parker | 60/770 |
| 3,193,130 | A | * | 7/1965 | Miller | 220/374 |
| 3,206,059 | A | * | 9/1965 | Fead et al. | 220/792 |
| D209,788 | S | * | 1/1968 | Cheladze | D9/452 |
| 3,362,575 | A | * | 1/1968 | Fotos | 206/508 |
| 3,384,265 | A | * | 5/1968 | Frank | 206/508 |
| 3,392,468 | A | * | 7/1968 | Wolf | 40/307 |
| 3,459,324 | A | * | 8/1969 | Miller | 220/374 |
| 3,524,566 | A | * | 8/1970 | Parks | 220/268 |
| 3,557,995 | A | * | 1/1971 | Mirasol et al. | 220/287 |
| 3,583,596 | A | * | 6/1971 | Brewer | 220/781 |
| 3,613,940 | A | * | 10/1971 | Davis | 220/781 |
| 3,632,016 | A | * | 1/1972 | Bozek | 206/519 |
| 3,679,088 | A | * | 7/1972 | Swett et al. | 220/789 |
| 3,679,089 | A | * | 7/1972 | Swett et al. | 220/801 |
| 3,690,504 | A | * | 9/1972 | Ragettli | 220/305 |
| 3,805,991 | A | * | 4/1974 | Cheladze et al. | 220/373 |
| 3,809,281 | A | * | 5/1974 | Kalkowski | 220/370 |
| D233,599 | S | * | 11/1974 | Davis | |
| 3,895,736 | A | * | 7/1975 | Swett | 220/782 |
| 3,895,743 | A | * | 7/1975 | Christian | 222/143 |
| RE28,658 | E | * | 12/1975 | MacDaniel | 229/403 |
| RE28,797 | E | * | 5/1976 | Brewer | 220/781 |
| 3,974,916 | A | * | 8/1976 | Bartolucci | 206/459.1 |
| 3,989,142 | A | * | 11/1976 | Gwilliam et al. | 206/508 |
| 4,006,839 | A | * | 2/1977 | Thiel et al. | 220/266 |
| 4,026,459 | A | * | 5/1977 | Blanchard | 229/404 |
| 4,106,660 | A | * | 8/1978 | Boyle | 220/712 |
| 4,109,820 | A | * | 8/1978 | Stifano | 220/240 |
| 4,117,950 | A | * | 10/1978 | Allen | 220/782 |
| 4,194,645 | A | * | 3/1980 | Zabner et al. | 220/781 |
| 4,234,100 | A | * | 11/1980 | Chabot | 220/785 |
| D259,403 | S | * | 6/1981 | Frazier, Jr. | D9/438 |
| 4,333,583 | A | * | 6/1982 | Montemarano | 220/712 |
| D271,857 | S | * | 12/1983 | Callahan | D9/438 |
| 4,421,244 | A | * | 12/1983 | Van Melle | 220/781 |
| 4,503,992 | A | * | 3/1985 | Sitko et al. | 220/713 |
| 4,518,096 | A | * | 5/1985 | Winstead | 220/268 |
| D280,600 | S | * | 9/1985 | Earl | D9/503 |
| 4,586,625 | A | * | 5/1986 | Garrett | 220/266 |
| D284,563 | S | * | 7/1986 | Merino | D9/451 |
| 4,615,459 | A | * | 10/1986 | Clements | 220/254.3 |
| D295,261 | S | * | 4/1988 | Wetter | D9/454 |
| 4,877,151 | A | * | 10/1989 | Rush et al. | 206/514 |
| 4,948,009 | A | * | 8/1990 | Sawatani | 220/229 |
| 4,953,743 | A | * | 9/1990 | Dart et al. | 220/369 |
| D323,116 | S | * | 1/1992 | Dart et al. | D9/447 |
| 5,147,065 | A | * | 9/1992 | Rush et al. | 220/709 |
| D353,769 | S | * | 12/1994 | Miller | D9/438 |
| 5,397,023 | A | * | 3/1995 | Toczek et al. | 220/709 |
| 5,799,814 | A | * | 9/1998 | Schaefer et al. | 220/254.1 |
| 5,839,603 | A | * | 11/1998 | Smith et al. | 220/782 |
| 5,971,195 | A | * | 10/1999 | Reidinger et al. | 220/521 |
| 5,984,131 | A | * | 11/1999 | Krueger et al. | 220/574 |
| 6,056,144 | A | * | 5/2000 | Strange et al. | 220/297 |
| 6,056,145 | A | * | 5/2000 | Rush et al. | 220/297 |
| 6,070,752 | A | * | 6/2000 | Nava et al. | 220/521 |
| 6,158,155 | A | * | 12/2000 | Boney | 40/307 |
| 6,196,411 | B1 | * | 3/2001 | Nava et al. | 220/521 |
| 6,302,288 | B1 | * | 10/2001 | Nava et al. | 220/212 |
| 6,311,860 | B1 | * | 11/2001 | Reidinger et al. | 220/521 |
| 6,488,170 | B1 | * | 12/2002 | Johnson | 220/254.2 |
| D473,791 | S | * | 4/2003 | Loris | D9/447 |
| 6,688,487 | B2 | * | 2/2004 | Oakes et al. | 220/788 |
| 6,840,398 | B1 | * | 1/2005 | Blumenschein | 220/782 |
| 6,932,234 | B2 | * | 8/2005 | D'Amato | 220/781 |
| 6,948,633 | B2 | * | 9/2005 | Freek et al. | 220/711 |
| 7,055,715 | B2 | * | 6/2006 | Maravich et al. | 220/792 |
| 7,100,787 | B2 | * | 9/2006 | Farnsworth et al. | 220/212 |
| 7,195,130 | B2 | * | 3/2007 | Pendergrass et al. | 220/254.1 |
| 7,210,577 | B2 | * | 5/2007 | Swayne | 206/308.1 |
| D560,120 | S | * | 1/2008 | Maravich et al. | D9/454 |
| 7,318,536 | B2 | * | 1/2008 | Maravich et al. | 220/780 |
| 7,328,791 | B1 | * | 2/2008 | Bosworth | 206/308.1 |
| D564,354 | S | * | 3/2008 | Maravich et al. | D9/452 |
| D574,238 | S | * | 8/2008 | Walker et al. | D9/452 |
| D585,279 | S | * | 1/2009 | Walker et al. | D9/452 |
| 7,484,639 | B2 | * | 2/2009 | Maravich et al. | 220/792 |
| 7,506,756 | B2 | * | 3/2009 | Bosworth, Sr. | 206/308.1 |
| 7,748,557 | B2 | * | 7/2010 | Robinson | 220/269 |
| 8,074,831 | B2 | * | 12/2011 | Walker et al. | 220/790 |
| 8,118,187 | B2 | * | 2/2012 | D'Amato | 220/324 |
| 8,403,174 | B2 | * | 3/2013 | Blake et al. | 220/780 |
| 8,919,591 | B2 | * | 12/2014 | Cai et al. | 220/215 |
| 2004/0011803 | A1 | * | 1/2004 | D'Amato | 220/780 |
| 2005/0109780 | A1 | * | 5/2005 | Pendergrass et al. | 220/254.1 |
| 2005/0178766 | A1 | * | 8/2005 | Washington et al. | 220/212 |
| 2005/0230406 | A1 | * | 10/2005 | Maravich et al. | 220/792 |
| 2005/0274727 | A1 | * | 12/2005 | Maravich et al. | 220/709 |
| 2008/0017651 | A1 | * | 1/2008 | Walker et al. | 220/711 |
| 2008/0041867 | A1 | * | 2/2008 | Jochem et al. | 220/780 |
| 2009/0159606 | A1 | * | 6/2009 | D'Amato | 220/781 |
| 2012/0255959 | A1 | * | 10/2012 | Cai et al. | 220/592.2 |

* cited by examiner

COVER WITH DEPRESSIONS FOR CLOSING A CONTAINER

CROSS-REFERENCE TO RELATED APPLICATIONS

None.

SUMMARY OF THE INVENTION

The invention relates to a lid for closing a container, which has an encircling thickening at its upper edge, wherein the lid is deep-drawn from a plastics material film or produced in an injection-moulding method and has a substantially downwardly directed edge flange engaging over the thickening of the container.

Numerous lids of that kind are known. They are in general mechanically mounted on the container and usually hold there sufficiently satisfactorily.

The invention has the object of so designing a lid of the stated kind that it can be applied to the container by hand and in that case guarantee a secure closure.

According to the invention this object is fulfilled in that the edge flange is constructed to be at least slightly inclined outwardly and is provided with a plurality of inwardly directed projections capable of engaging under the thickening of the container.

Through this design, with a plurality of projections, an expenditure of force which is not unduly low is needed for applying the lid, which has the consequence of a clearly audible snapping on of the lid. It is thus ensured that complete application of the lid takes place and can be acoustically checked. In addition, a secure retention of the lid on the container is guaranteed by this plurality of projections.

It has in that case proved particularly advantageous if in accordance with the invention the projections are formed to be roof-shaped as seen in section.

It is thus ensured that the lid does not hook by its projections at the edge of the container.

Equally, it is very advantageous if in accordance with a further embodiment of the invention the lower one of the two roof surfaces is arranged to be flatter than the upper roof surface.

As a result, notwithstanding the plurality of projections the lid can still be placed by hand on the container, whilst a very effective retention is guaranteed by the steeper inner roof surfaces.

A further advantageous embodiment of the invention is characterised in that the projections are arranged at a small spacing from one another.

Thus, on the one hand the desired pressing-on pressure is guaranteed and on the other hand deformation of the lid edge is avoided.

It is also very advantageous if in accordance with a further embodiment of the invention the lid area bounded by the edge flange is over at least a part of its extent drawn in or drawn up towards the container at least slightly.

A very high degree of stiffness of the lid is thereby achieved, which comes in useful particularly when placing the lid on the container.

In that case, it has proved very advantageous if the lid area part drawn in or drawn up towards the container is of annular form.

A further advantageous embodiment of the invention is characterised in that the lid centre section, lying within the lid annular surface part, is of pot-shaped construction.

This similarly contributes to further stiffening of the lid.

This is further assisted if in accordance with a further embodiment of the invention the pot-shaped lid centre section is shaped outwardly.

Equally, it has proved very advantageous if in accordance with a further embodiment of the invention a further, substantially planar lid area of annular form is provided between the pot-shaped lid centre section and the lid annular surface part.

It is also very advantageous if several depressions or elevations are provided in the lid.

According to the invention, the depressions or elevations are provided in the lid annular surface part.

It is then particularly advantageous if the depressions are arranged to connect with the planar lid area.

In that case it is particularly advantageous if, in accordance with a further embodiment of the invention, the depressions have a greater depth towards the planar lid area than towards the edge flange.

The stiffness of the lid is thus substantially increased. The lid material can be of thinner construction, which has the consequence of a not inconsiderable saving of material.

It has then proved particularly advantageous if in accordance with a further embodiment of the invention the depressions have a greater width towards the planar lid area than towards the edge flange.

As a result, in addition to the structural stiffness which is produced there is introduced into the lid an elasticity which ensures an even better and more secure snapping of the lid onto the container.

A further, very advantageous embodiment of the invention, is characterised in that depressions and elevations of different design that are respectively arranged in alternation are provided.

In a further advantageous embodiment of the invention, it is provided that a frangible location or piercing is provided within the base of the pot-shaped lid centre section.

By way of this frangible location or piercing, it is possible to introduce, for example, a drinking straw into the container.

According to an advantageous embodiment of the invention, the frangible location and/or piercing is or are formed by two cut lines of cruciform arrangement.

A further advantageous embodiment of the invention resides in impressing different items of information into the lid.

In that case, it is particularly advantageous if, in accordance with a further embodiment of the invention, the items of information are arranged in the planar lid area.

The items of information are thereby readily visible, but nevertheless protected against damage.

It has also proved very advantageous, in accordance with the invention, if an inner sealing lip or sealing flank capable of tightly bearing against the inner side of the container is provided.

A very good sealing of the lid relative to the container is thereby ensured. Liquid located in the container is prevented from reaching the thickening. Due to the double sealing at the sealing lip or sealing flank and thickening, the container closed by the lid according to the invention is also sealed against surging.

The invention is illustrated, by way of an exemplifying embodiment, in the drawing, in which.

Figure 1:
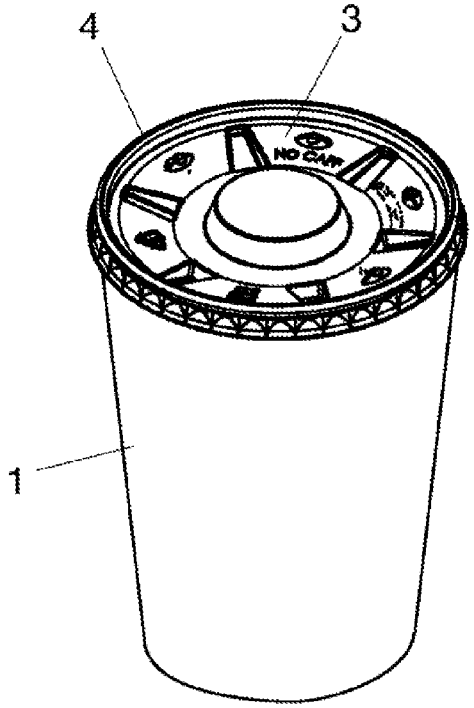
FIG. 1 shows a diagrammatic illustration of a beaker-shaped container with fitted lid in accordance with one embodiment of the present invention.
Figure 2:
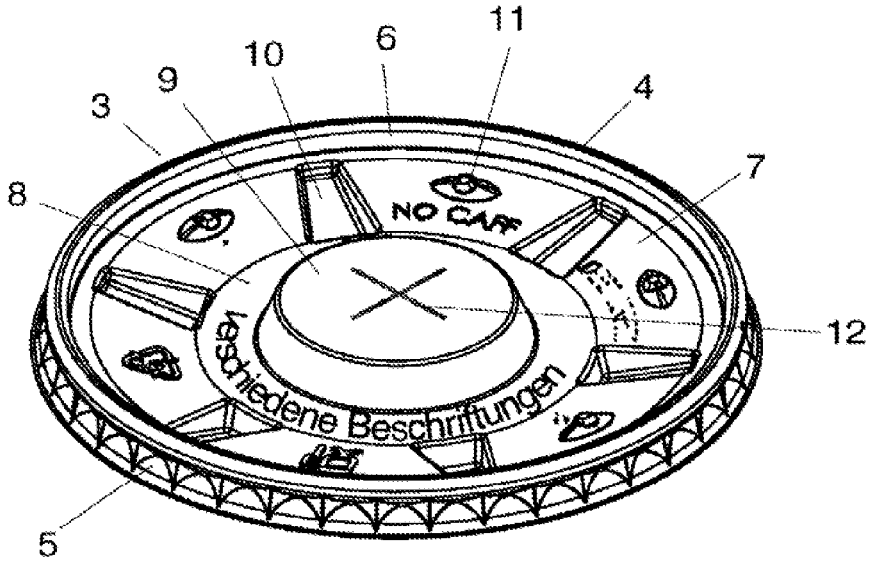
FIG. 2 shows a schematic illustration of the lid in accordance with one embodiment of the present invention.
Figure 3:
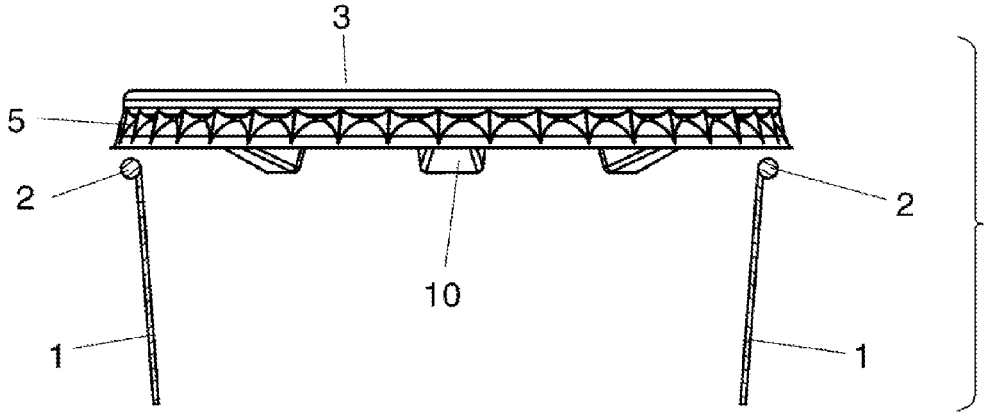
FIG. 3 shows a section through the lid in accordance with one embodiment of the present invention.
Figure 4:
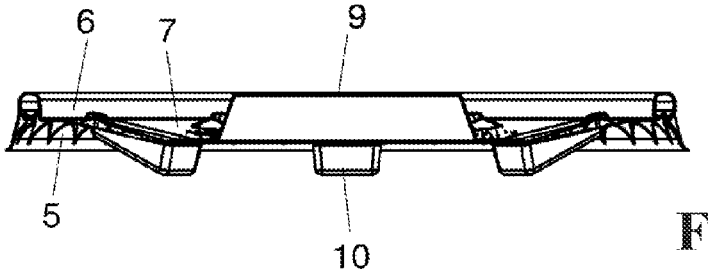
FIG. 4 shows a section through the lid shown in FIG. 6 taken generally along line 4-4 in the direction of the arrows.
Figure 5:
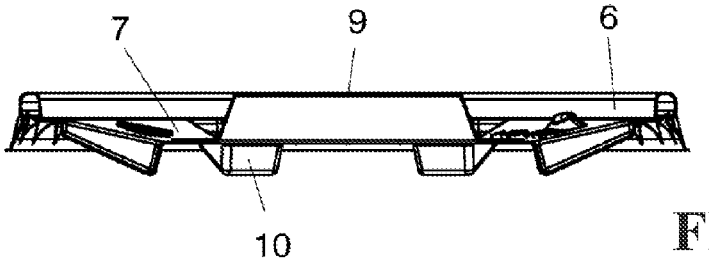
FIG. 5 shows a section through the lid shown in FIG. 6 taken generally along line 5-5 in the direction of the arrows.
Figure 6:
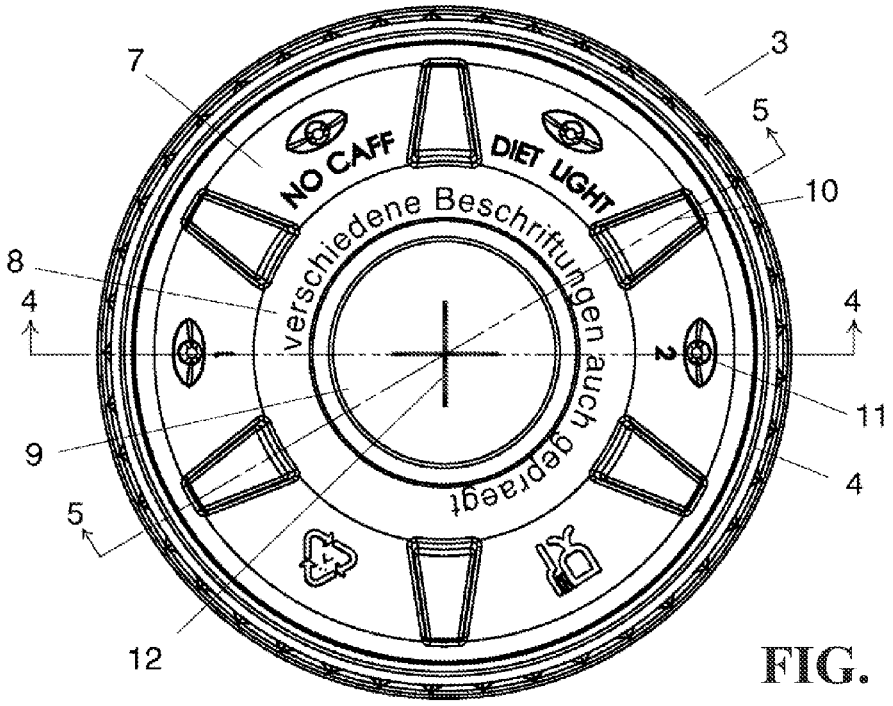
FIG. 6 shows a plan view of the lid in accordance with one embodiment of the present invention.
Figure 7:
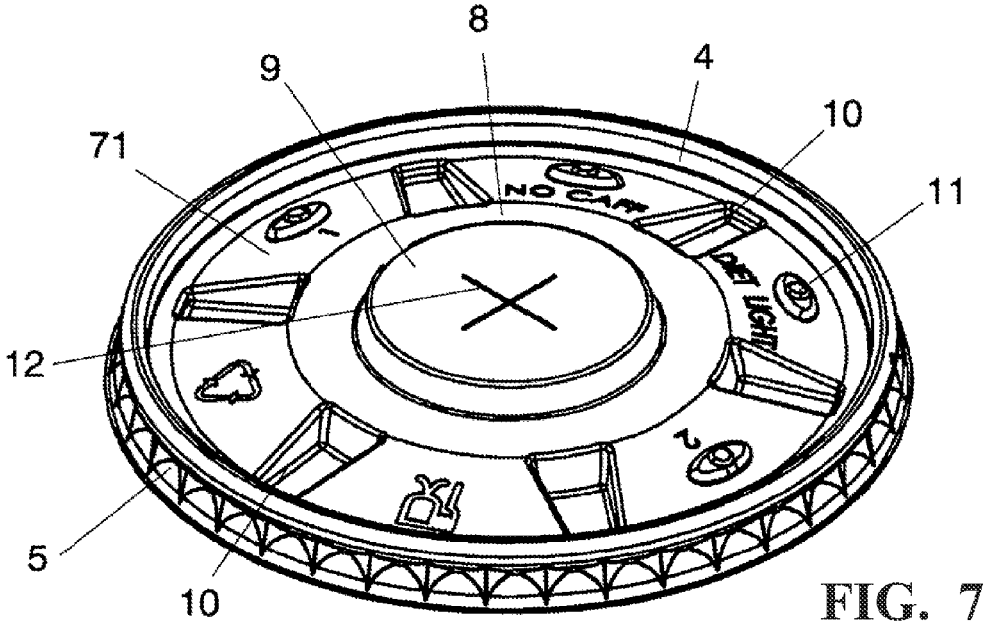
FIG. 7 shows a schematic illustration of a further lid in accordance with one embodiment of the present invention.
Figure 8:
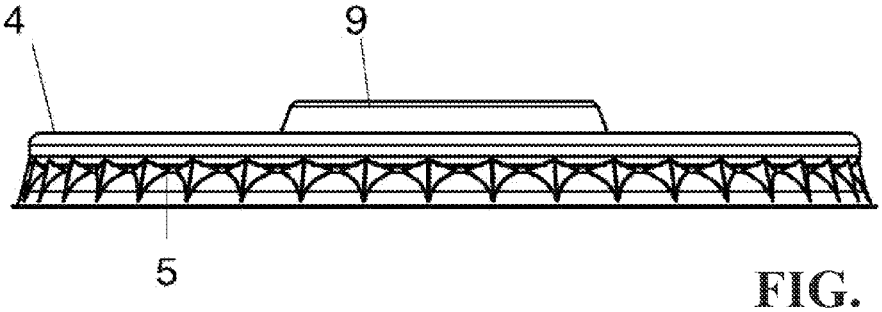
FIG. 8 shows a side view of this lid in accordance with one embodiment of the invention.
Figure 9:
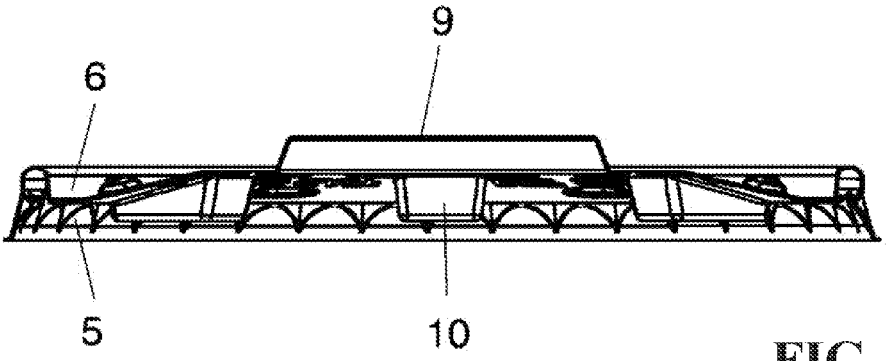
FIG. 9 shows a section through the lid shown in FIG. 11 taken generally along line 9-9 in the direction of the arrows.
Figure 10:
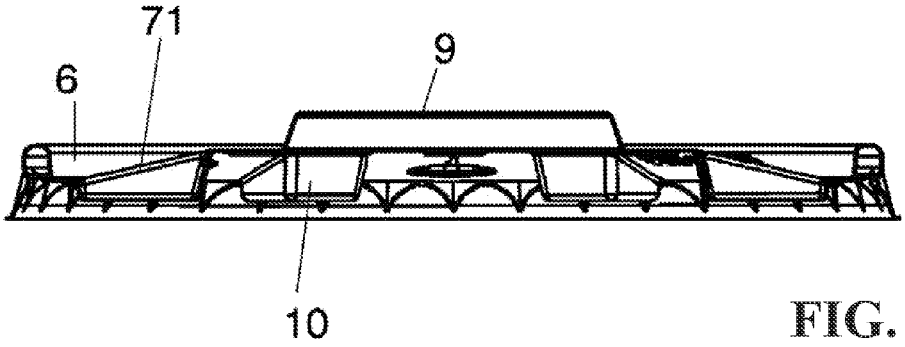
FIG. 10 shows a section through the lid shown in FIG. 11 taken generally along line 10-10 in the direction of the arrows.
Figure 11:
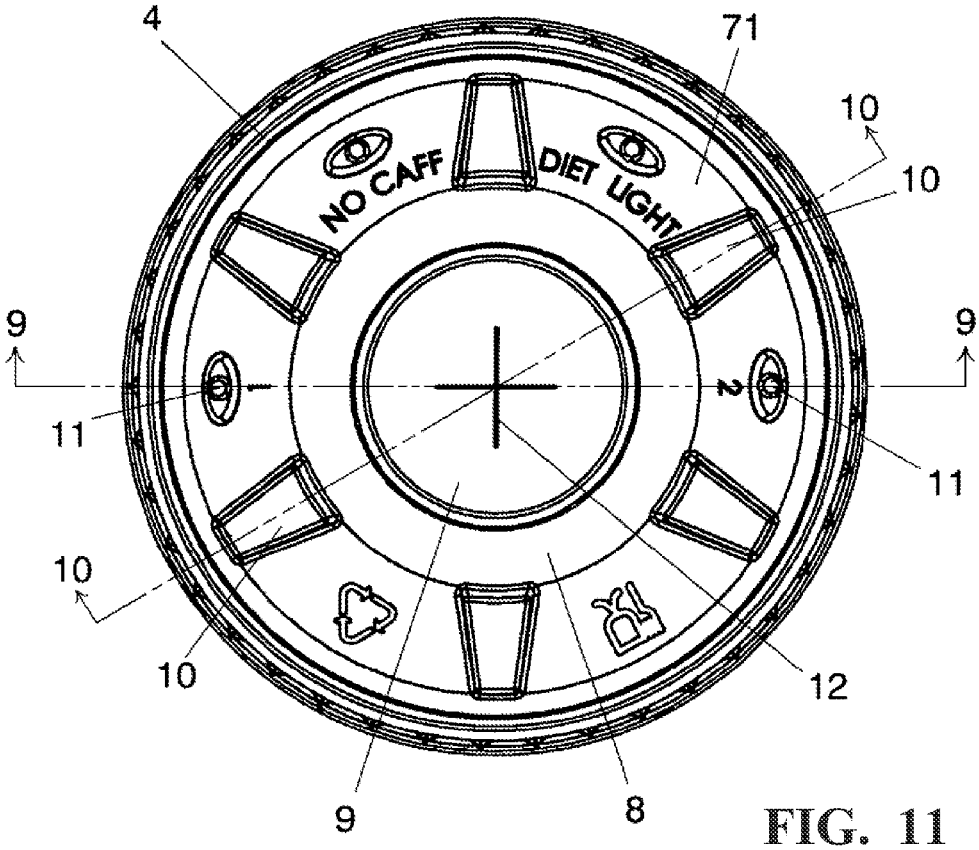
FIG. 11 shows a plan view of this lid in accordance with one embodiment of the present invention.

A beaker-shaped container is denoted in FIG. 1 by 1, the container being wound from, for example, coated cardboard and having an outwardly wound roll 2 at its upper, open end. Placed on this container 1 is a lid 3 which is produced from a plastics material film in deep-drawing method or by injection-moulding and includes an edge flange 4, which points downwardly and is drawn up slightly towards the outside. Provided in this edge flange 4 is a plurality of inwardly directed projections 5 which in the state of being placed on the container 1 engage under the roll 2 and fix the lid to the container. These projections are formed to be roof-shaped as seen in cross-section, wherein the downwardly directed roof surface is formed to be less steep than the upper roof surface. The lower roof surface can thereby easily slide on the roll 2, whilst the upper roof surface slides less easily over the roll 2 and thus imparts firm retention to the lid 3.

In addition, the projections 5 are arranged very closely adjacent to one another so that the roof overall is held very firmly on the container.

Going out from the edge flange 4 a roof area part 17, which is drawn in towards the inside at an inclination, is inwardly connected with an at least approximately vertically extending projection 6. This roof area part 7 can, however, also be drawn up towards the outside as illustrated in FIGS. 7, 8, 9, 10 and 11. There the outwardly drawn-up roof surface part is denoted by the numeral 71. Provided in the middle section of the lid is a lid area 8, which in the illustrated exemplifying embodiment, is arranged around a lid centre section 9 of pot-shaped construction arranged to be elevated relative to the lid area 7 or 71 and the lid area section.

The lid area 8 is of substantially planar construction. Depressions 10, which stiffen not only the lid areas 8, but also the entire lid 3, are arranged in the lid area part 7 or 71 uniformly over the circumference. The depressions 10 in that case have a greater depth towards the lid centre than towards the edge flange 4. In addition, the width of the depressions 10 at the inner end thereof is greater than at the outer end thereof.

The depressions 10 directly adjoin the lid areas 8, but can also adopt a spacing therefrom.

In addition, elevations 11, which in the illustrated examples have an oval cross-section and are formed to be rounded, can be provided between adjacent depressions 10. These elevations ensure further stiffening of the lid 3.

Two crossing cut lines 12 producing a weakening of the lid material are provided in the lid centre section 9. A straw can be inserted into the beaker 1, which is closed by the lid 3, in this opening defined by these two cut lines 12.

The walls of the container 1 are inclined outwardly towards the roll 2 at least slightly.

Thereagainst, the projection 6 is constructed to be vertical, so that this is pressed at least by its lower edge against the walls of the container 1 and thus ensures sealing. Liquid contained in the container cannot pass as far as the roll 2 and the edge flange 4. The container 1 is thereby sealed against surge.

In that case, it is also conceivable for the projection 6 to run approximately parallel to the walls and thus create a seal.

The lid 3 can carry inscriptions, which, for example, can be impressed, primarily in the region of the lid areas 8.

The plastics material film from which the lid 3 is produced can be made from a single-layer or multi-layer material. It is conceivable to use for this purpose PS, PE, PP, PET or, however, also biological materials, such as, for example, PLA. Other materials are conceivable. The lid can be coated not only on its inner side, but also on its outer side. A metallisation or an anti-adhesion or separating agent, for example, is conceivable as coating.

In cases where the lid includes biologically degradable materials or water-soluble materials, it is conceivable to protect the inner side of the lid material with a thin PE layer or another plastics material.

The lid 3 can be shaped by means of any desired thermoplastic deformation method.

By virtue of the described structural construction, the lid 3 includes acoustic perceptibility and has excellent stability.

In addition, due to the stability and furnishing with a sealing flank, excellent tightness against surge is guaranteed. The roll 2 is protected against liquid, but forms, in combination at the edge flange 4, a further seal.

By virtue of the high degree of stability, it is possible to substantially reduce the material thickness of the lid 3, whereby material and costs can be saved.

The invention claimed is:

1. A lid for closing a container having an encircling thickening at an upper edge, the lid comprising:

a substantially downwardly directed edge flange engaging over the thickening of the container, wherein the edge flange is formed to be at least slightly inclined outwardly and is provided with a plurality of inwardly directed projections, said projections capable of engaging under the thickening of the container;

a first lid area bounded by the edge flange;

a centre section;

a second lid area provided between the centre section and the first lid area; and a plurality of depressions, the depressions being downwardly directed and having a depth that is greater towards the second lid area than towards the edge flange and a width that is greater towards the second lid area than towards the edge flange;

a plurality of elevations;

wherein the plurality of depressions and the plurality of elevations are provided on the first lid area, and the plurality of depressions are elongate in a radial direction and are arranged to connect with the second lid area; and wherein the lid is deep-drawn from a plastics material film or is produced by injection moulding a plastics material.

2. The lid according to claim 1, wherein the projections are narrowly spaced from one another.

3. The lid according to claim 1, wherein the depressions each have a shape different from that of the elevations and wherein the depressions and the elevations are respectively arranged in alternation.

4. The lid according to claim 1, further comprising an inner sealing lip or an inner sealing flank capable of tightly bearing against an inner side of the container.

5. The lid according to claim 1, wherein the depressions extend downwardly below the second lid area.

6. The lid according to claim 1, wherein the depressions extend downwardly below the first lid area, the centre section and the second lid area.

7. The lid according to claim 1, wherein the projections are roof-shaped as seen in section.

8. The lid according to claim 7, wherein a lower one of two roof surfaces is arranged more flatly than an upper roof surface.

9. The lid according to claim 1, wherein different items of information are impressed into the lid.

10. The lid according to claim 9, wherein the items of information are arranged in the second lid area.

11. The lid according to claim 1, wherein the first lid area includes at least a part of an extent drawn in or drawn towards the container at least slightly when the lid is combined with the container.

12. The lid according to claim 11, wherein the first lid area is drawn in or drawn towards the container and is of annular form.

13. The lid according to claim 12, wherein the lid centre section lies within the first lid area and is constructed to be pot-shaped.

14. The lid according to claim 13, wherein the pot-shaped lid centre section has an outward moulding.

15. The lid according to claim 13, wherein the second lid area is of a substantially planar annular form.

16. The lid according to claim 13, wherein a frangible location or piercing is provided within a base of the pot-shaped lid centre section.

17. The lid according to claim 16, wherein the frangible location or piercing is formed by two cut lines in cruciform arrangement.

18. A lid for closing a container having an encircling thickening at an upper edge, the lid comprising:

a substantially downwardly directed edge flange engaging over the thickening of the container, wherein the edge flange is formed to be at least slightly inclined outwardly and is provided with a plurality of inwardly directed projections capable of engaging under the thickening of the container;

a first lid area bounded by the edge flange;

a centre section;

a second lid area provided between the centre section and the first lid area; and a plurality of depressions extending in an elongate radial direction, the depressions being downwardly directed toward the container and having a depth that is greater towards the second lid area than towards the edge flange and a width that is greater towards the second lid area than towards the edge flange;

a plurality of elevations;

wherein the plurality of depressions each have a shape different from that of the plurality of elevations and wherein the depressions and the elevations are respectively arranged in alternation; and wherein the lid is deep-drawn from a plastics material film or is produced by injection moulding a plastics material.

19. The lid according to claim 18, wherein the depressions and elevations are provided in the first lid area.

20. The lid according to claim 18, wherein the depressions are arranged to connect with the second lid area.

* * * * *